United States Patent [19]

Anderson et al.

[11] 4,010,302

[45] Mar. 1, 1977

[54] TUFTED FACE CARPET TILE

[75] Inventors: Ray C. Anderson; Joseph H. Kyle, both of Troup County, Ga.

[73] Assignee: Carpets International-Georgia (Sales), Inc., LaGrange, Ga.

[22] Filed: Apr. 12, 1976

[21] Appl. No.: 675,888

Related U.S. Application Data

[63] Continuation-in-part of Ser. No. 524,813, Nov. 18, 1974, abandoned.

[52] U.S. Cl. ..... 428/95; 428/82

[51] Int. Cl.² ..... D03D 27/00; D04H 11/00; D05C 17/00

[58] Field of Search ..... 428/82, 88, 90, 95

[56] References Cited

UNITED STATES PATENTS 3,014,829 12/1961 Curtin ..... 428/82

3,120,083 2/1964 Dahlberg ..... 428/95

*Primary Examiner*—Marion E. McCamish

*Attorney, Agent, or Firm*—Burns, Doane, Swecker & Mathis

[57] ABSTRACT

An improved carpet tile for commercial, industrial or home use is disclosed. The carpet tile includes a tufted carpet facing portion including a stiffening and stabilizing layer (e.g., a primary backing layer and a glass fiber layer) in which the tufted carpet portion is embedded. The backing portion also includes a stiffening and stabilizing layer (e.g., glass fiber layer). Interposed between the facing and backing portions is a resilient thermoplastic material (e.g., polyvinyl chloride). The resulting unitary carpet tile shows surprising dimensional stability, stiffness and floor hugging properties even during periods of concentrated stress.

16 Claims, 1 Drawing Figure

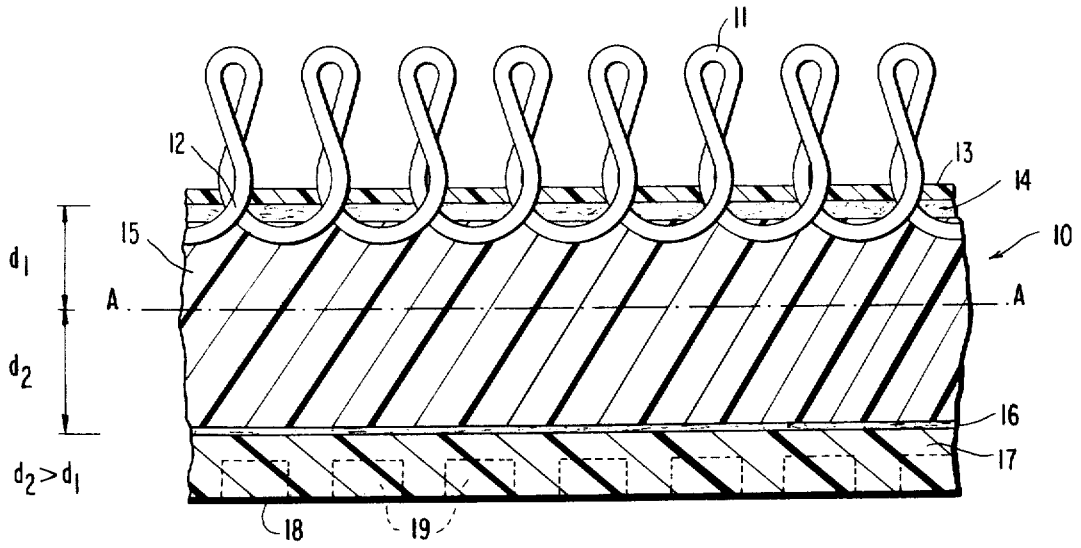
11
12
13
14
10
15
A
A
$d_1$
$d_2$
16
17
$d_2 > d_1$
18
19

TUFTED FACE CARPET TILE

CROSS-REFERENCE TO RELATED APPLICATION

This application is a continuation-in-part of our copending U.S. patent application Ser. No. 524,813, filed Nov. 18, 1974 now abandoned.

BACKGROUND OF THE INVENTION

In recent years there has been considerable interest in carpet tiles. Carpet tiles offer considerable advantages over rugs or wall to wall carpeting which has heretofore been used extensively. For example, the use of carpet tiles for floor covering allows removal of individual tiles which have become worn or soiled more than other tiles. Those tiles which are not worn or soiled may be left in place. Additionally, tiles may be rearranged or replaced to enhance decorative effects.

Carpet tile and carpet construction are, of course, well-known in the art and are shown, for example, in U.S. Pat. Nos. 3,402,094; 3,347,735; 3,764,448; 3,238,595; 2,776,233; 3,173,823; 3,309,259; 3,320,113; 3,515,622; 3,642,516, 3,120,083; and 3,014,829. In addition, carpet tiles of various constructions have been available commercially.

Generally, carpet tiles as known heretofore have included a pile fabric facing set in a layer of resilient thermoplastic (including elastomeric) material which is stiffened with a layer of suitable stiffening fibers such as of glass, polypropylene, nylon or the like. The tile is generally backed with another layer of resilient elastomeric or thermoplastic material to which an adhesive may be applied to set the carpet tile onto the floor. Commercially available carpet tiles are available with an adhesive applied on the backing and a strippable protective layer attached thereto. In use, the protective layer is stripped off and the carpet tile applied to the floor surface. While the known carpet tile constructions offer many advantages over conventional rugs, wall to wall carpeting or the like, many problems remain.

Dimensional stability is important in a carpet tile. Dimensional stability, as understood in the art, is the ability of a carpet tile to lie flat and a remain flat and square on a floor surface under conditions of normal use. To achieve commercially acceptable dimensional stability, particularly dimensional stability under concentrated stress (as when a wheeled object such as a desk chair, couch, typewriter stand or the like, traverses a floor composed of a plurality of carpet tiles), it has generally heretofore been necessary to adhere the carpet tiles to the floor with a suitable adhesive. The use of an adhesive, however, diminishes the advantageous features of carpet tiles as compared with rugs or wall to wall carpeting. An adhesive-installed tile requires substantial time and effort to remove or replace an individual tile. When the carpet tile is backed with an adhesive layer, it is often difficult to precisely align the carpet tile since the tile sticks to the floor surface as soon as it is placed in contact therewith.

Tiles which are not adhesively adhered to the floor (known as free-lay tiles) have heretofore been too dimensionally unstable, particularly when subjected to concentrated stress, to be commercially practical. It has been proposed to prestress the carpet tiles during manufacture to overcome the dimensional stability problem. A pre-stressed carpet tile of this type can be manufactured, for example, with a dome-type of orientation in which the center of the tile is slightly higher than all of the corners. This construction is purported to reduce dimensional instability, particularly under concentrated stress. It has been found, however, that carpet tiles of this type do not lie flat and tend to form exaggerated domes in use. This different type of dimensional instability also makes this type of carpet tile commercially unsatisfactory.

Another important consideration is the flame retardant and smoke emission characteristics of the carpet tile. Commercially available carpet tile products are subjected to the stringent flame retardant and smoke characteristics requirements set forth in ASTM E-84. It has been suggested to utilize a glass fabric material both for the backing and for the pile surface in order to meet these rigid requirements. See, for example, U.S. Pat. No. 3,764,448. While an all glass fabric may satisfy these flame and smoke requirements, glass fibers are often irritating to humans and thus not particularly suitable for use in such a situation in which the fiberglass fiber would be expected to come in contact with human skin. In addition, glass filaments are known to be relatively stiff, brittle and self abrasive. Their use makes processing and formation of carpet material more difficult. Carpet and/or carpet tile manufacturers thus tend to minimize the use of glass fibers as much as possible.

OBJECTS AND SUMMARY OF THE INVENTION

It is an object of this invention to avoid or alleviate the problems of prior art.

It is a further object of this invention to provide a carpet tile which has acceptable flame retardance and low smoke emission properties.

It is also an object of this invention to provide a carpet tile which is dimensionally stable and which resists puckering under loads of concentrated stress such as found in commercial or home use.

It is further an object of this invention to provide a carpet tile which offers an improved balance of floor hugging, dimensional stability, flame retardance and smoke emission properties.

It is also an object of this invention to provide a carpet tile which is relatively supple, comfortable and nonirritating to human skin.

In one aspect the present invention provides a tufted face carpet tile comprising:

- a facing portion including tufted carpet yarn projecting from said facing portion, a primary backing portion and a first stiffening and stabilizing portion of glass fibers;
- a resilient backing portion including a second stiffening and stabilizing portion of glass fibers and a layer of resilient thermoplastic; and
- said carpet tile including a layer of resilient thermoplastic material between said stiffening and stabilizing portions of glass fibers, said stiffening and stabilizing portions of glass fibers providing substantial heat shielding effects to the carpet tile.

In another aspect of the invention, there is provided a tufted face carpet tile having a balance of dimensional stability, floor-hugging, flame retardance and low smoke emission properties comprising an upper portion having a tufted surface, a layer of resilient thermoplastic material and including a first stiffening and stabilizing membrane disposed below the tufted surface in which the tufted surface is embedded;

a backing portion bonded thereto and including a second stiffening and stabilizing membrane and a layer of resilient thermoplastic material;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward.

BRIEF DESCRIPTION OF THE DRAWING

The FIGURE illustrates a cross-sectional view of a carpet tile section of the present invention;

DETAILED DESCRIPTION OF THE INVENTION

Referring now to the FIGURE, there is shown a preferred embodiment of the carpet tile of the present invention. The carpet tile 10 includes generally a facing surface which includes a tufted carpet facing 11 such as cotton, wool, or any suitable natural or synthetic fiber. The tufted carpet facing 11 is embedded (e.g., by back stitches 12) in the primary backing layer 13 which can be formed of any conventional natural or synthetic, woven or non-woven primary backing material such as cotton, jute, rayon, paper, nylon, polypropylene or the like. Woven polypropylene yarn is preferred. The glass scrim layer 14 which is disposed below the primary backing 12 imparts stiffening and dimensional stability to the facing portion. The facing portion of tufted carpet facing 11, primary backing layer 13 and glass scrim layer 4 includes also a layer 15 which can be formed of any suitable resilient thermoplastic material. Such materials are well known in the art. Suitable thermoplastic materials include elastomeric materials such as the natural or synthetic rubbers such as sponge or foam rubber, polychloroprene, acrylonitrile-butadiene copolymers, ethylene-propylene-diene rubbers, and the like. Other suitable thermoplastic materials include petroleum resins, vinyl polymers, polybutene resins, polyisobutene-butadiene resins and copolymers and mixtures thereof. A preferred resilient thermoplastic material is a vinyl polymer such as polyvinyl chloride, polyvinylidine chloride, polyvinyl acetate, polyvinyl acetal, polyvinyl butyral, copolymers of any of these vinyl polymers and mixtures thereof. Polyvinyl chloride is most preferred.

Disposed beneath layer 15 is a layer 16 which is a layer of non-woven glass fibers. This layer 16 imparts significant dimensional stability and resistance to puckering to the carpet tile. That is, this stiffening layer 16 is disposed further below the bend axis of the composite carpet tile (which bend axis is indicated by dotted line A—A in the Figure) than the stiffening and stabilizing layers 13 and 14 are disposed above the bend axis. Thus, the moment arm from the bend axis A—A to the stiffening and stabilizing layer 16 is greater than the opposite moment arm from the bend axis A—A to the composite stiffening and stabilizing layer formed by the stiffening layers 13 and 14. The latter two stiffening and stabilizing layers 13 and 14 are disposed adjacent to each other (as described above) and tend to act together for stiffening and stabilizing purposes as a single unit or membrane. Due to this larger moment arm below the bend axis of the carpet tile, the application of a lateral force to the pile (or top) surface of the carpet tile imparts to the tile a greater tendency to bend downward than to bend upward. This improves the free-lay nature of the tile since the tendency of the tile to hug the floor overrides the tendency of the tile to turn upward under concentrated loads. In this manner, the resistance to rippling or dislodgement during movement of wheeled bodies across the carpet tile is substantially increased. It will be understood by those skilled in the art that the distances of the stiffening layers 13, 14 and 16 from the bend axis can be altered by altering the thickness of layers 15 and 17 of resilient thermoplastic material. In all cases, however, the distance from the bend axis of layer 16 is greater than the corresponding distance for the composite layers 13 and 14 so as to provide the floor-hugging property as described above.

Beneath the fiberglass layer 16 is a conventional backing layer 17 which can be formed, for example, of a suitable thermoplastic material such as the various natural or synthetic rubbers, or various synthetic polymeric materials described above. The vinyl polymer preferred for use in layer 12 may also be advantageously utilized herein. In a preferred aspect of the invention, the layer 17 is provided on its bottom face 18 with a series of indentations, corrugations, or the like to impart a friction increasing effect to the bottom of the tile to increase its resistance to movement in use and to increase its tendency to remain in position on the floor. Such friction-increasing indentations, indicated generally as 19 in the Figure, are well known per se in the art.

It will be understood that although the description of the carpet tile of the present invention has been given above in terms of "layers" that the carpet tile is a bonded unitary structure in which the individual layers are not easily discernible or removable from one another.

The carpet tile of the present invention can be constructed in any manner suitable to yield the desired materials in the proper orientation in a form in which the pile surface may be subsequently adhered. Suitable processes will be apparent to those skilled in the art. Advantageously, the composite bonded structure can be manufactured as an indeterminate length of material of about the width ultimately desired in the carpet tile or multiple thereof.

For example, a glass scrim layer can be disposed upon a polypropylene yarn primary backing material and nylon, cotton or wool fiber is tufted through the layers in a conventional fashion. The tufted loops are formed on the underside of the resulting composite with the back stitches on the top. The back stitches assist in maintaining the composite in place during processing. A layer of resilient thermoplastic material is thereafter applied in a form in which the thermoplastic material will adhere to the composite, lock the back stitches in place and bind the glass scrim to the polypropylene. The resilient thermoplastic material may be applied, for example, in the form of a plastisol of polyvinyl chloride or the like.

Generally, the thermoplastic material is added as a relatively stiff plastisol which is heated to gel and partially fuse the plastisol coating. A non-woven glass fiber layer is then disposed on the thermoplastic layer. Advantageously, another layer of the plastisol of the thermoplastic material is first disposed on the non-woven glass fiber layer, the plastisol layers are each heated to gel and partially fuse and the non-woven glass fiber layer is adhered to the pile-faced composite by pressing the heated thermoplastic materials together. In this manner, the thermoplastic layer 15 of the Figure which is relatively thick (and which has concomitant relatively long gel times) can be formed by the consolidation of two thinner layers each of which takes a much shorter time to gel. Substantial process economies thus results.

The backing layer of thermoplastic material may then be applied (again conveniently in the form of a relatively stiff plastisol) which may be heated to gel and partially cure the thermoplastic material. While heated, the carpet tile precursor may then be passed under an embossing roller which embosses the back of the carpet with indentations, corrugations or the like to form a friction-increasing surface and assists in consolidating the layers into a unitary product. The consolidated carpet material may then be severed by suitable cutting means into appropriate length sections. For example, the carpet tile may be formed as an indeterminate length sheet of from 18 to 54 inches wide and then cut by suitable cutting means in the same length to thus form squares.

The carpet tile of the present invention is particularly adapted to be formed in a continuous-manner as set forth above. In continuous processes of the prior art, stresses may be induced in the machine direction in a component of the carpet tile such as, for example, a synthetic primary backing, e.g., polypropylene. The induced stresses remain in the memory of the synthetic material and tend to cause dimensional instability in the resulting product. For example, the synthetic material may tend to be stretched in the machine direction during processing. In the final product, the reaction to such stretching is a shrinkage of the synthetic material which tends to cause the outer edges of the carpet tile to curl upward. Such tiles thus require adhesive application to the underlying support to prevent curling or "cupping" of the carpet tile.

The construction of the carpet tile of the present invention substantially avoids or alleviates this problem. The glass fiber layer disposed adjacent the primary backing is essentially inextensible. Since the two layers tend to act together as a single membrane during processing, the glass fiber layer substantially prevents stretching of the synthetic material of the primary backing layer and imparts a high degree of stability to the composite. Since the synthetic primary backing material is essentially unstretched during processing, there is little if any stress induced during processing which will cause cupping in the resulting carpet tile.

The resulting carpet tile product is suitable for use as a floor covering in home and/or commercial use where substantial flame retardance is desired and is particularly suitable for use in an office environment in which substantial high stress concentrations (e.g., wheeled traffic) is applied across the tiles. The tiles have a dense pile and do not require adhesives for installation. The individual modules may be replaced or rotated as necessary or desired. The carpet tiles also have dimensional stability with substantially no curling, slipping, buckling, stretching or shrinking. In addition, the carpet tiles have low smoke emission.

The invention is additionally illustrated in connection with the following Examples which are to be considered as illustrative of the present invention. It should be understood, however, that the invention is not limited to the specific details of the Examples.

EXAMPLE I

A non-woven glass scrim layer is disposed on a layer of woven polypropylene yarn. The resulting composite is fed to a conventional tufting machine which tufts nylon fibers through the interstices of the composite. Tufting is performed such that the resulting tufts protrude from the underside (i.e., polypropylene face) of the composite with the back stitches, which hold the tufts in place, on the topside of the composite. The resulting material is 18 inches wide or multiples thereof and of continuous length.

A layer of polyvinyl chloride is applied to the top side of the tufted-faced composite as a relatively stiff plastisol. The coated material is leveled with a doctor blade which levels and smooths the polyvinyl chloride layer and forces the polyvinyl chloride into engagement with the glass scrim and polypropylene yarn layers. The coated material is heated to 360° F to gel and cure the polyvinyl chloride. The coated material is then contacted with a non-woven glass fiber layer which is also coated with a polyvinyl chloride layer which is also applied as a relatively stiff plastisol, leveled by a doctor blade, heated to 360° F. and advanced to the contact point.

The polyvinyl chloride layers of each coated material contact each other and are consolidated by passing between two rollers which apply a slight pressure to the material.

After consolidation, a backing layer of polyvinyl chloride is applied as a relatively stiff plastisol, leveled by a doctor blade, heated and embossed by an embossing roll to form indentations on the bottom. The embossed carpet material is cut into carpet tile squares.

Upon examination of a carpet tile square, it is determined that the lowest non-woven glass fiber layer in the composite carpet tile is disposed further below the horizontal bend axis of the carpet tile than the glass scrim layer and polypropylene layers are disposed above that bend axis.

EXAMPLE II

A portion of an office floor surface is covered with the carpet tiles of Example I. The tiles are each applied to the floor surface without adhesive, that is, as free-lay tiles.

These carpet tiles are observed under varying conditions of typical office use. The carpet tiles of the present invention show no signs of dimensional instability even under concentrated stress e.g., when wheeled vehicles, chairs or the like, traverse the tiles, and do not require adhesive bonding to the floor.

The carpet tiles of the present invention also show good flame retardance and low smoke emission values. Thus, the carpet tiles of the present invention offer an optimum balance of properties for maximum commercial utilization.

This balance of dimensional stability, floor hugging ability, flame retardance and low smoke emission properties is achieved by the carpet tile construction of the present invention. When a carpet tile is formed utilizing a first stiffening and stabilizing membrane (e.g., glass fibers) but without a second stiffening and stabilizing membrane, the resulting carpet tile is dimensionally unstable and has poor flame retardance and smoke emission properties. The inclusion of a second stiffening and stabilizing membrane of glass fibers in the backing portion generally improves the flame retardance and smoke emission properties but the resulting carpet tile is dimensionally unstable under concentrated stress and requires adhesive application to a floor unless the second stiffening and stabilizing membrane is disposed further below the horizontal bend (or neutral) axis of the carpet tile than the first stiffening and stabilizing membrane is disposed above the horizontal bend axis. However, even if a second stiffening and stabilizing membrane is utilized, the second stiffening and stabilizing membrane should not be located so far below the horizontal (or neutral) bend axis so as to be essentially at the bottom of the carpet tile that the flame retardance and smoke emission properties are adversely affected in a test such as ASTM E-84.

It will be seen that the desired effect of this aspect of the present invention is to utilize the second stiffening and stabilizing membrane to isolate as much of the resilient thermoplastic material in the backing portion of the carpet tile from the direct impingement of the flame such as used in the ASTM-84 test without disposing the membrane closer to the bend axis than the first stiffening and stabilizing membrane is disposed above that bend axis. Thus, a balance in these properties should be achieved. The use of a foam layer of the thermoplastic material as the intermediate layer between the first and second stiffening and stabilizing membranes adversely affects the flame retardance and smoke emission properties of the resulting carpet tiles in comparison with the use of a relatively stiff (non-foamed) layer of the thermoplastic material.

The principles, preferred embodiments and modes of the operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A tufted face carpet tile comprising:

a facing portion including tufted carpet yarn projecting from said facing portion, a primary backing portion and a first stiffening and stabilizing portion of glass fibers;

a resilient backing portion including a second stiffening and stabilizing portion of glass fibers and a layer of resilient thermoplastic material; and said carpet tile including a layer of resilient thermoplastic material between said stiffening and stabilizing portions of glass fibers, said stiffening and stabilizing portions of glass fibers providing substantial heat shielding effects to the carpet tile.

2. The carpet tile of claim 1 wherein said tufted carpet yarn is imbedded in said primary backing portion and first stiffening and stabilizing portion.

3. The carpet tile of claim 2 wherein said resilient backing portion includes a layer of resilient thermoplastic material having friction-increasing means on one face of said layer, the said second stiffening portion of glass fibers being adjacent to said layer of resilient thermoplastic material at an opposite face thereof and another layer of the resilient thermoplastic material adjacent to the said portion of glass fibers at the opposite face of the glass fiber portion.

4. The carpet tile of claim 3 wherein the resilient thermoplastic material of the facing portion and the resilient backing portion is the same.

5. The carpet tile of claim 4 wherein the resilient thermoplastic material is a vinyl polymer.

6. The carpet tile of claim 5 wherein said vinyl polymer is polyvinyl chloride.

7. The carpet tile of claim 2 wherein said primary backing portion is a layer of woven or non-woven natural or synthetic fibrous material.

8. The carpet tile of claim 7 wherein said primary backing portion is woven polypropylene.

9. A tufted face carpet tile section comprising in interposed, bonded relationship:

a. a carpet facing layer of tufted carpet yarn embedded in a layer of a primary backing material and a first glass fiber stiffening and stabilizing layer;

b. a layer of resilient thermoplastic material;

c. a second glass fiber stiffening and stabilizing layer; and d. a backing layer of a resilient thermoplastic material whereby said glass fiber stiffening and stabilizing layers provide substantial heat shielding effects to the carpet tile.

10. The carpet tile section of claim 9 wherein each said resilient thermoplastic material is a vinyl polymer of polyvinyl chloride, copolymers or mixtures thereof.

11. A tufted face carpet tile having a balance of dimensional stability, floor-hugging, flame retardance and low smoke emission properties comprising an upper portion having a tufted surface, a layer of resilient thermoplastic material and including a first stiffening and stabilizing membrane disposed below the tufted surface in which the tufted surface is embedded;

a backing portion bonded thereto and including a second stiffening and stabilizing membrane and a layer of resilient thermoplastic material;

a layer of resilient thermoplastic material between the said first and second stiffening and stabilizing membranes;

the said second stiffening and stabilizing membrane being fruther below the horizontal bend axis of the carpet tile than the said first stiffening and stabilizing membrane is above the said horizontal bend axis whereby application of lateral force to the pile surface imparts a greater tendency for the tile to bend downward than bend upward, the said second stiffening and stabilizing membrane being located above the bottom of the said carpet tile to provide in conjunction with the first stiffening and stabilizing membrane flame retardance and low smoke emission properties to the resulting carpet tile.

12. The carpet tile of claim 11 wherein said upper portion includes a primary backing layer disposed between the tufted surface and the first stiffening and stabilizing membrane.

13. The carpet tile of claim 12 wherein the thermoplastic material is a vinyl polymer.

14. The carpet tile of claim 13 wherein the primary backing layer is a layer of woven polypropylene.

15. The carpet tile of claim 14 wherein the backing portion includes friction-increasing means on the bottom thereof.

16. A free-laying tufted face carpet tile having dimensional stability and floor-hugging properties comprising an upper portion having a tufted surface and including a primary backing membrane and a first stiffening and stabilizing membrane disposed below the tufted surface in which the tufted surface is embedded;

a backing portion bonded thereto and including a second stiffening and stabilizing membrane comprising glass fibers and a layer of resilient thermoplastic material;

a layer of resilient thermoplastic material between the said first and second stiffening and stabilizing membrane;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward.

* * * * *